US005181649A

United States Patent [19]

Frost

[11] Patent Number: 5,181,649

[45] Date of Patent: Jan. 26, 1993

[54] SANDWICH SERVING CONTAINER

[76] Inventor: John H. Frost, 781 S. Kohler St., Los Angeles, Calif. 90021

[21] Appl. No.: 821,586

[22] Filed: Jan. 16, 1992

Related U.S. Application Data

[63] Continuation-in-part of Ser. No. 735,851, Jul. 25, 1991, abandoned.

[51] Int. Cl.[5] ..... B65D 5/38

[52] U.S. Cl. ..... 229/19; 229/DIG. 13; 426/115

[58] Field of Search ..... 229/19, DIG. 13; 220/4.21, 315; 426/115, 128; 206/309, 525

[56] References Cited

U.S. PATENT DOCUMENTS

| | | | |
|---|---|---|---|
| 4,079,880 | 3/1978 | Edwards | 220/4.21 |
| 4,189,054 | 2/1980 | Liu et al. | 229/DIG. 13 |
| 4,221,320 | 9/1980 | Faller | 229/19 |
| 4,322,000 | 3/1982 | Struble | 229/19 |
| 4,494,689 | 1/1985 | Ilitch | 229/19 |
| 4,585,124 | 4/1986 | Pride | 206/525 |
| 4,627,534 | 12/1986 | Komiyama et al. | 206/309 |
| 4,771,883 | 9/1988 | Herr et al. | 206/309 |
| 4,875,578 | 10/1989 | Nehl | 206/309 |

*Primary Examiner*—Allan N. Shoap
*Assistant Examiner*—Christopher J. McDonald
*Attorney, Agent, or Firm*—Jack C. Munro

[57] ABSTRACT

A food serving container which includes a tray upon which the food product is to be located. This tray is composed of a front section and a back section which are connected together at a bend line. During consumption, the food product is to be held by one hand at, and while the food rests on, the back section, while roughly half the food product extends over the bend line to the front. When the tray is exposed, the front section lowers at the bend line to a deflected position allowing room for the lower jaw and easy consumption, while at the same time functioning to catch and hold any food drippings that may occur. The tray is enclosed by a cover in the form of a rigid walled lid or flexible bag prior to consumption.

21 Claims, 6 Drawing Sheets

80
84
102
8
86
100
104
112
108
110
94
82
92
36
98
96
90
88

106

SANDWICH SERVING CONTAINER

REFERENCE TO PRIOR APPLICATION

This application is a Continuation-In-Part of U.S. patent application Ser. No. 07/735,851, filed Jul. 25, 1991, entitled "SANDWICH SERVING CONTAINER", by the present inventor.

BACKGROUND OF THE INVENTION

1. Field of the Invention

The field of this invention relates to containers for food products and more particularly to a food product which is designed to be consumed while being held in the consumer's hand, more particularly, to food held inside of and supported by the serving container while being consumed.

2. Description of Prior Art

Food products which are consumed while being held in the consumer's hand are extremely common. One particular common such food product is the sandwich and specifically a bun-type sandwich. These types of sandwiches are in widespread usage within fast food type of restaurants. It is common that these kinds of sandwiches are purchased by individuals from motor vehicles and the sandwich is consumed as the individual operates the motor vehicle.

Such sandwiches contain bread, meat, tomatoes, dressing, catsup, mustard, onion, lettuce and other similar types of food materials. It is exceedingly common that during the consuming process that there may be produced a dripping which may be either the bread, meat or some liquid or semi-liquid material such as the dressing. The consumer may be impeccably dressed and while consuming of the foodstuff, a food dripping may occur on the clothing of the individual. This can prove to be undesirable especially if the consumer is en route to an important meeting or similar type of activity.

In the past there have been produced containers for supporting and facilitating of eating of the foodstuff directly from the container. These types of containers have been designed for the purpose of minimizing direct contact with the hand or hands of the consumer and also function to collect any food drippings that may occur. However, these types of containers have not functioned with any great degree of success. These containers are known to interfere with the normal consuming process of the foodstuff. Eventually, during the consuming process, the user may become frustrated and end up causing food drippings to be dispensed exteriorly of the container and invariably in contact with the consumer's clothes.

SUMMARY OF THE INVENTION

The structure of the present invention is directed to a sandwich serving container which is designed to facilitate the consuming primarily of a hamburger or any whole, uncut sandwich, directly out of the container, while eliminating any food drippings from falling free of the container and contaminating an exterior structure such as vehicle upholstery and/or clothes of the consumer. The sandwich serving container is constructed of a tray having a planar bottom which has an upstanding wall attached at the periphery of the bottom. The bottom and the upstanding wall combine to form a chamber within which the sandwich is to be located. This tray is formed in two sections, a back section and a front section which are connected together by a bend line. Approximately half of the hamburger rests on the back section and is held in one hand of the consumer with the thumb of the hand resting on the exterior surface of the bottom of the tray and the fingers contacting the top of the sandwich from its midpoint to its back side. Various embodiments of completely detachable lids allow access to the hamburger and tray by the hand for both consumption (above described) and for support of the tray before and during disengagement of the lid to prevent buckling or bending. When the lid is removed, the front section of the tray assumes a downwardly deflected position becoming a spill collecting chamber. The front wall or bottom of this front section may include a depression to allow additional space to accommodate the lower jaw of the consumer between said chamber and the now overhanging sandwich permitting ease of access to the sandwich by the mouth of the consumer. As consumption occurs, the fingers of the sandwich holding hand (above described) are able to move the sandwich from the back section to overhang the front section and be available to the consumer's mouth until the sandwich is completely consumed with no container interference to lips, chin, neck or hands, and minimal need to reposition the sandwich with the other hand of the consumer. Any food drippings are to be caught by the deflected front chamber and collected therein. Any drippings in the back section are confined to the chamber in the back section. The tray can also be enclosed by a bag. There may also be utilized a rigid support plate usable primarily in conjunction with the bag enclosure of the tray, placed between the sandwich and the bottom of the tray. This rigid support plate is to provide a means of support as the bag is removed until the user sees the need to place his or her fingers under the bottom to prevent the sandwich from falling when the front chamber deflects. This support plate is to be disengaged and discarded prior to consumption of the sandwich.

Some of the objectives of the present invention are to provide a sandwich container which is simple to use and permits one hundred percent consumption of a sandwich without removal from the container, without repositioning the container and without the need for paper wrapping, minimizing the risk of contamination of exterior structure and which can be produced at such a low cost that the serving container can be readily disposed of after each use.

These objectives are accomplished by allowing the consumer to hold a sandwich inside of a container while at the same time positioning the upper and lower teeth around the top and bottom of the sandwich with no container interference to the lips, chin or neck of the consumer, and no interference to the consumer's ability to both grip simultaneously with one hand the sandwich and container, and to manipulate the sandwich.

DETAILED DESCRIPTION OF THE SHOWN EMBODIMENTS

Figures 1, 2, 3, 4:
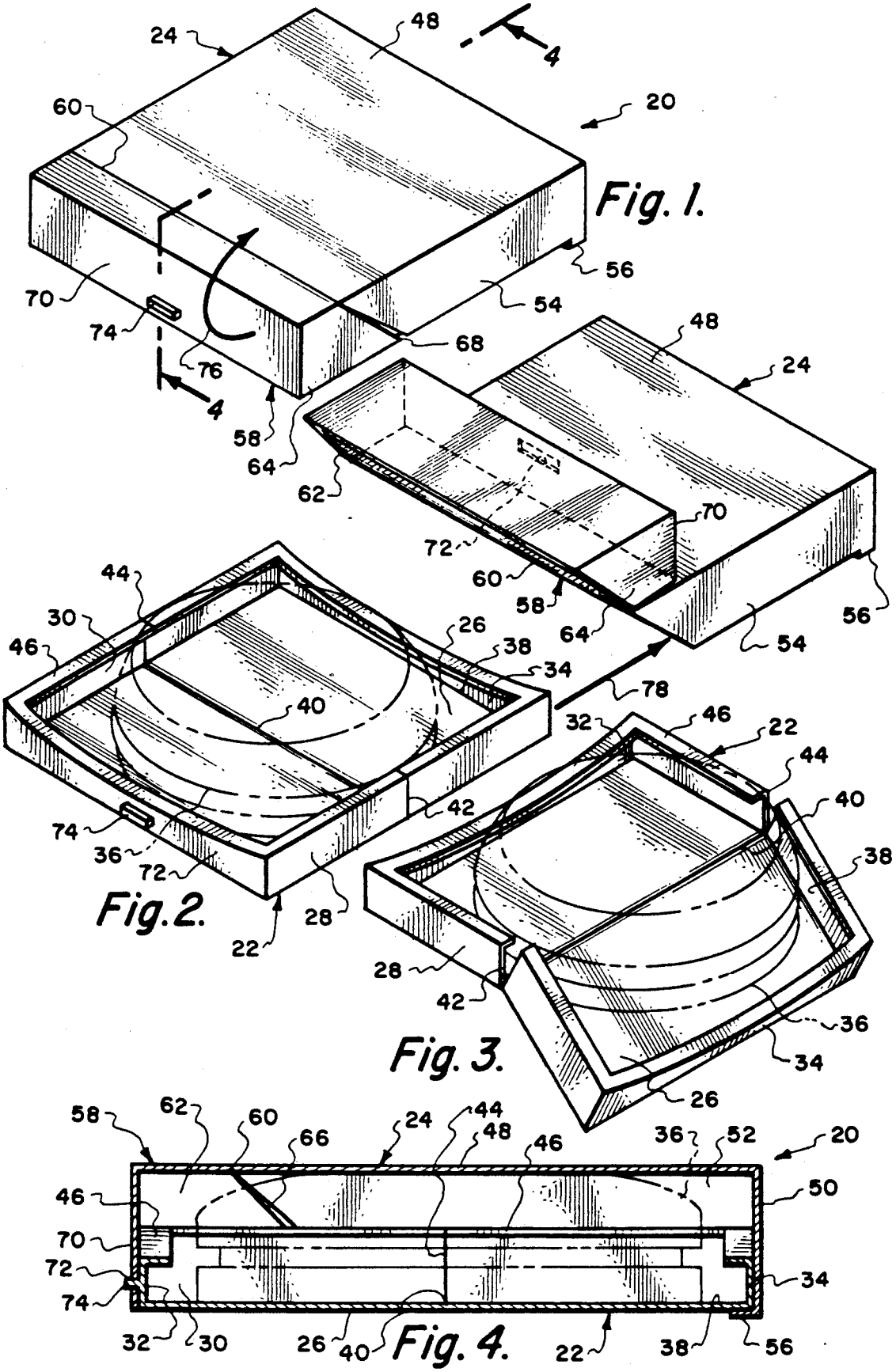
FIG. 1 is an isometric view of the first version of sandwich container of the present invention showing the container usable in conjunction with a rigid wall enclosing lid.
FIG. 2 is an exploded isometric view showing the enclosing lid separated from the sandwich tray depicting a sandwich located in conjunction with the tray.
FIG. 3 is a view of the sandwich container of the present invention showing the position of the tray as it would be during the consuming of the sandwich.
FIG. 4 is a cross-sectional view of the sandwich container of the present invention taken along line 4—4 of FIG. 1.
Figures 5, 6, 7, 8:
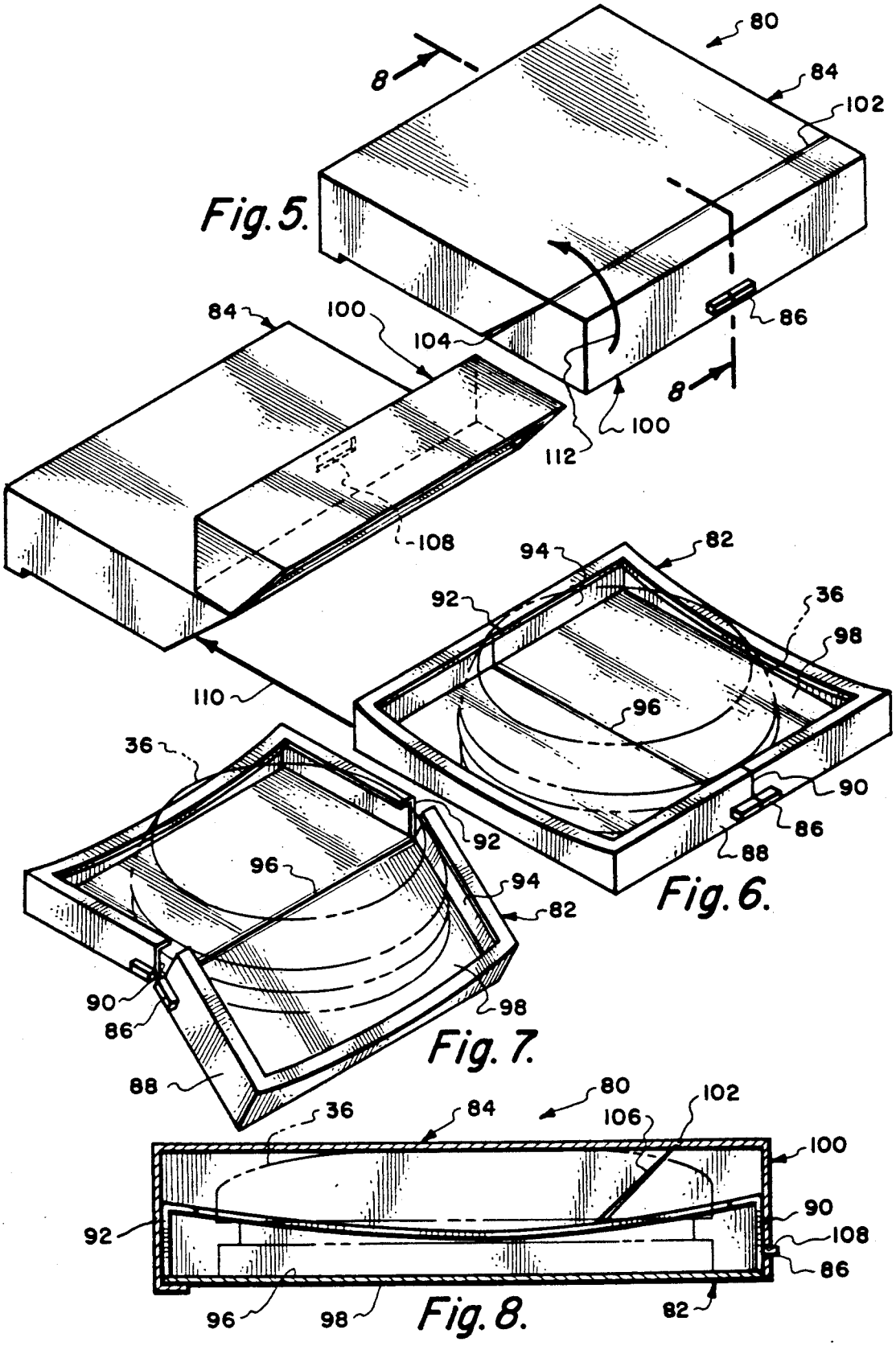
FIG. 5 is an isometric view similar to FIG. 1 showing the latch between the enclosing lid and the tray positioned at the bend line as opposed to FIG. 1 where the latch is located spaced from the bend line.
FIG. 6 is an exploded isometric view similar to FIG. 2 but of the sandwich container of FIG. 5.
FIG. 7 is a view similar to FIG. 3 but of the tray for the sandwich container of FIG. 5.
FIG. 8 is a cross-sectional view of the sandwich container taken along line 8-8 of FIG. 5.
Figure 9:
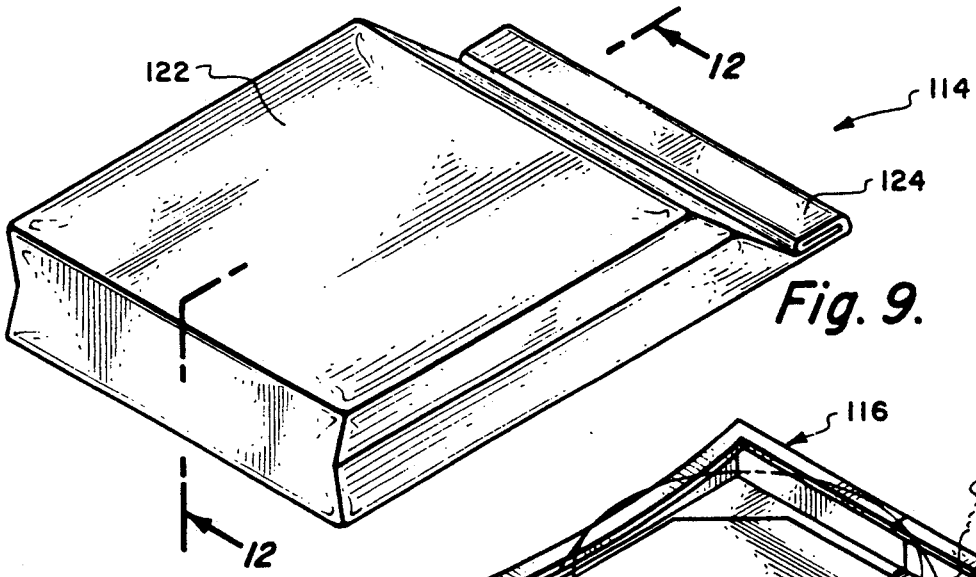
FIG. 9 is an isometric view of the sandwich container of the present invention wherein the tray is enclosed by a bag cover.
Figure 10:
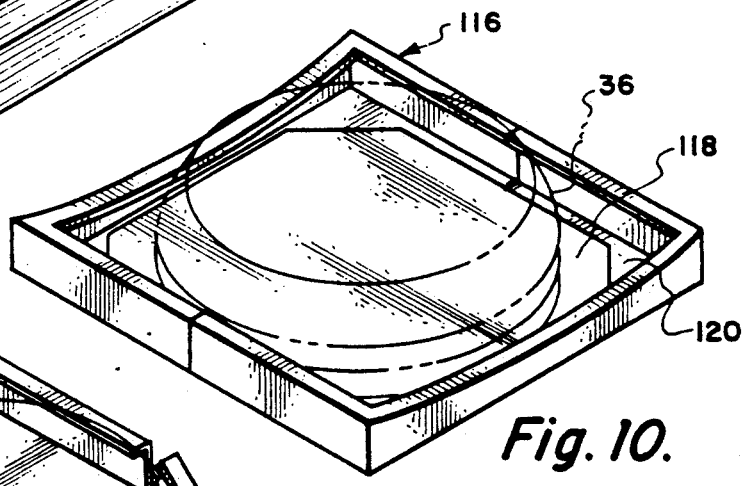
FIG. 10 is an isometric view of the tray of the sandwich container which is contained within the bag shown in FIG. 9.
Figure 11:
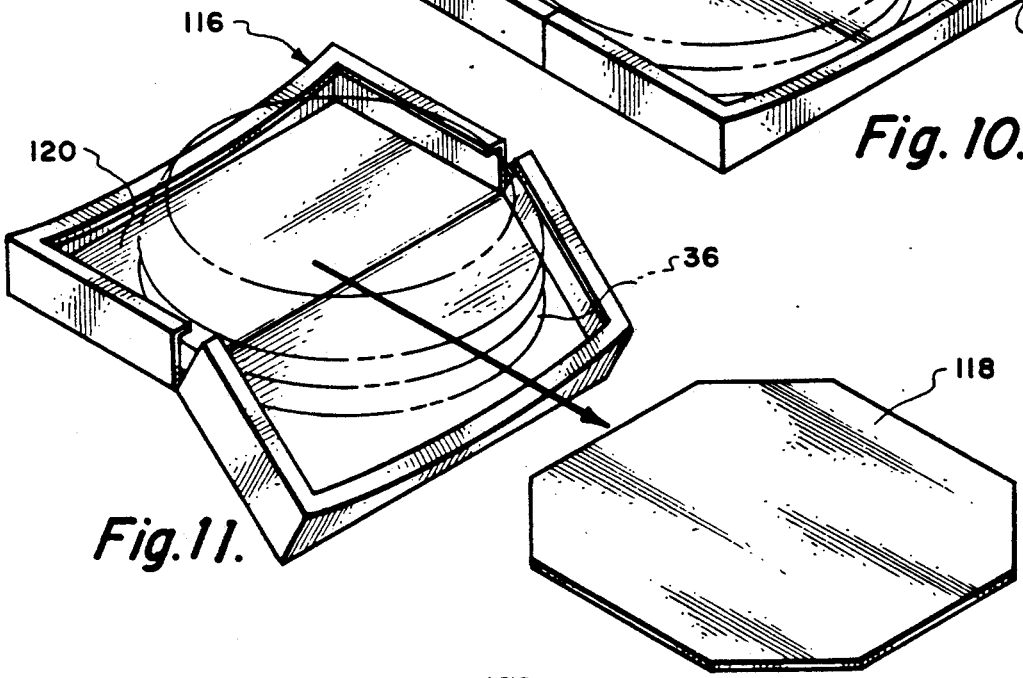
FIG. 11 is a view similar to FIG. 7 but of the tray of FIG. 10 showing usage with a rigid support plate in conjunction with the base.
Figure 12:
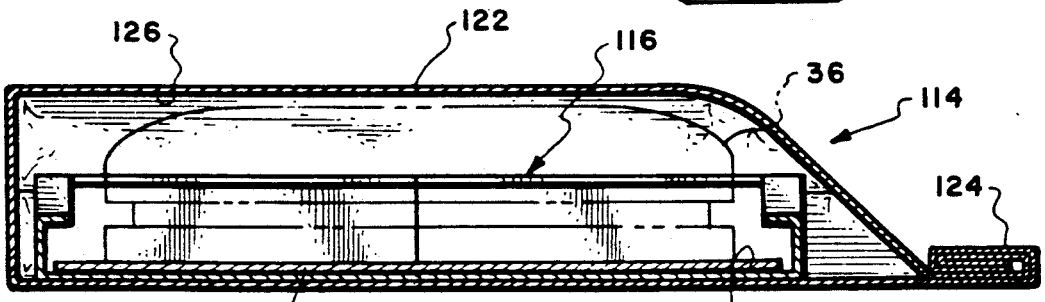
FIG. 12 is a cross-sectional view of the sandwich container of the present invention taken along line 12—12 of FIG. 9.

Conventional sandwich containers are designed to insulate and protect the user from spills only when the container is closed not open. Using of the container at a table presents no problem especially if the user has a table available to collect any spills. However, usage of such a container by passengers in a car can be messy, and usage by the driver can be dangerous. Many traffic fatalities are directly related to people eating while driving, because in trying to prevent or to clean up spills on their clothes, they are forced to take their eyes off the road. It is believed this product could save many lives.

For convenience, most depictions of walls and flanges have been at right angles. It should be understood that all such walls and flanges may be at obtuse angles to allow easier stacking prior to use of the container.

Referring particularly to FIGS. 1–4 of the drawings there is shown the first version 20 of the sandwich container of this invention. This first version is constructed of a tray 22 and a lid 24. The tray 22 is defined by a rectangularly shaped planar bottom 26 to which is fixedly secured at the periphery thereof side walls 28 and 30 and end walls 32 and 34. The side walls 28 and 30 and the end walls 32 and 34 connect together to form an enclosing continuous wall. It is to be noted that the end walls 32 and 34 are slightly different from side walls 28 and 30. The end walls 32 and 34 are slightly recessed so that the height of the end walls 32 and 34 in the middle of their length is less than at their ends. The reason the end walls 32 and 34 are depressed slightly is to provide additional clearance for the consumer's chin during consuming of the sandwich 36 which is located within the internal compartment 38 which is enclosed by the bottom 26 and the walls 28, 30, 32 and 34.

The tray 22 is actually formed of two different sections (a back section and a front section) which are of substantially equal size and are separated by a score (or bend) line 40 dividing the planar bottom. Connecting with bend line 40 are slits 42 and 44 which divide respectively side walls 28 and 30 in half. During consuming of the sandwich 36, the user is to manually hold the back end of the sandwich against the bottom 36 of the back section leaving free the consumed end of the sandwich 36. When the sandwich is partially consumed, the consumer will find it easy to shift the position of the sandwich with only one hand. The front section of the bottom 26 that is located at the consuming end of the tray 22 deflects due to the slits 42 and 44 and the bend line 40. This deflection is clearly shown in FIG. 3. The reason for this deflection is to expose the sandwich 36 so as to facilitate its consumption and if any crumbs or discharge is emitted from the sandwich 36 as it is being consumed, that discharge of material will be caught within the internal chamber 38 of the front section of the base 22 that is deflected. It should be noted that in this embodiment, the front and back sections are interchangable, meaning such are identical in construction.

It is envisioned that the material of construction for the entire base 22 will be a thin sheet material of paper or plastic. In order to provide strength to the side walls 28 and 30 and to the end walls 32 and 34 there is affixed to the top edge of each a flange extending inwardly in the direction of the internal chamber 38. The flange 46 also functions to collect any crumbs or discharge from the sandwich 36 and retain such within the internal chamber 38 that is within the front section of the tray 22.

Prior to consuming of the sandwich 36 it is normally desired to have the sandwich 36 protected from the ambient. In order to achieve such protection there is utilized an enclosing lid 24. Lid 24 is also to be constructed of thin sheet material, paper or plastic, but is to be sufficiently rigid to maintain its shape. The lid 24 defines a top 48 which is again basically rectangular and is of substantially the same size as the bottom 26. Integrally attached to the peripheral edge of the top 48 is a back wall 50 and side walls 52 and 54. Back wall 50 is located at the back end of lid 24. The back wall 50 has an inwardly extending bottom flange 56. When the cover 24 is installed on the tray 22, the end wall 34 is to rest against the bottom flange 56 thereby securing in position the back end of the lid 24 relative to the tray 22.

The forward end of the lid 24 is formed into a front flap 58. The front flap 58 is connected to the top 48 by means of a score line 60. The front flap 58 has side walls 62 and 64 which are contiguous with side walls 52 and 54, respectively. Separating side walls 62 and 52 is a slit 66. A similar slit 68 separates walls 64 and 54.

The front flap 58 also includes a front end wall 70. This front end wall 70 has an opening 72 formed therein. A protuberance 74 is formed on the end wall 32 of tray 22. The protuberance 74 is to be located within the opening 72 which locates the lid 24 in the position shown in FIG. 1 closing of the internal chamber 38 to the ambient. In essence, the protuberance 74 in conjunction with the opening 72 functions as a latch to lockingly retain in position the lid 24 to the tray 22.

When the user desires to begin consumption of the sandwich 36, the user needs only to manually remove end wall 70 from disengagement with protuberance 74 and then move such in the direction of arrow 76 from the score line 60 to the position shown in FIG. 2 of the drawings. The lid 22 is then to be slid in the rearward direction depicted by arrow 78 to disengage the lid 24 from the flange 56 and tray 22. At that time, the sandwich 36 can now be consumed in the manner previously described. Normally after consumption of the sandwich 36, the tray 22 and the lid 24 are to be discarded becoming trash. It should be noted that except for flange 56, the lid is open at the bottom which allows the consumer's hand to be under and in direct contact with the bottom of the tray during the time the other hand is slipping off the lid, thus preventing the front section (and possibly the sandwich) from dropping before the consumer is properly prepared.

Referring particularly to FIGS. 5 through 8 of the drawings, there is shown the second version 80 of this invention. The second version 80 includes a tray 82 which is similar to tray 22 and a lid 84 which is similar to lid 24. Basically, the construction of the lid 84 and the tray 82 is essentially identical to lid 24 and tray 22. For a detailed description of lid 84 and tray 82, reference is to be to lid 24 and tray 22.

The main difference from the version of FIGS. 5 to 8 from the version of FIGS. 1 to 4 is that the protuberance 86, which is equivalent to protuberance 74, is mounted on the side wall 88 of the tray 82. Side wall 88 is essentially equivalent to side wall 28. The protuberance 86 is mounted across the slit 90 which is equivalent to slit 42. The slit 90 on the side wall 88, as well as slit 92 on the wall 94, connect with the bend line 96 located across the bottom 98 of the tray 82.

In comparing the second version 80 to the first version 20 it can be seen that the lid 84 is turned ninety degrees. The lid 84 includes a front flap 100 which is connected by a score line 102 to the remaining portion of the lid 84. Along the side walls of the lid 84 are slits 104 and 106 which permit the opening 108 formed within the lid 84 to be disengaged from the protuberance 86 and the front flap 100 pivoted in the direction of arrow 112. The lid 84 is then to be slid in the direction of arrow 110 to be disengaged from the tray 82.

It is to be noted that one half of the protuberance 86 is located on the rear section of the tray 82 with the remaining half of the protuberance 86 being mounted on the front deflectable section of the tray 82. The sandwich 36 is still to be consumed in the same manner as was discussed in relation to the version of FIGS. 1 to 4. In the version of FIGS. 5 to 8 the latching action between the protuberance 86 and the opening 108 functions also to prevent any buckling of the base 82 due to the weight of the sandwich 36 prior to the time the sandwich 36 is being consumed.

Referring particularly to the third version 114 shown in FIGS. 9 to 12, there is shown a tray 116 which is essentially similar to tray 22 except the protuberance 74 is omitted. The sandwich 36 is to be consumed in the same manner on the tray 116. However to prevent buckling of the tray 116 under the weight of the sandwich 36, there may be utilized a thin rigid support plate 118 which is inserted between the sandwich 36 and the bottom 120 of the tray 116. It is to be understood that prior to consumption of the sandwich 36, the support plate 118 is to be manually removed and discarded. It is also considered within the scope of this invention that the support plate 118 could be utilized with the first version 20 and the second version 80 of this invention.

In order to enclose the sandwich 36 prior to consumption, there may be used a cover in the form of a flexible walled bag 122. The sandwich 36 and tray 116 are to be loosely located within bag 122. The bag 122 is to be sealed by the sealing lip 124. The sealing lip is to be readily disengagable by the user which permits forming an opening into the bag 122 to manually grasp the tray 116 and remove such along with the sandwich 36 from the enclosed chamber 126 of the bag 122. After the consumption of the sandwich 36, the bag 122 as well as the tray 116 is to be discarded.

Figure 13:
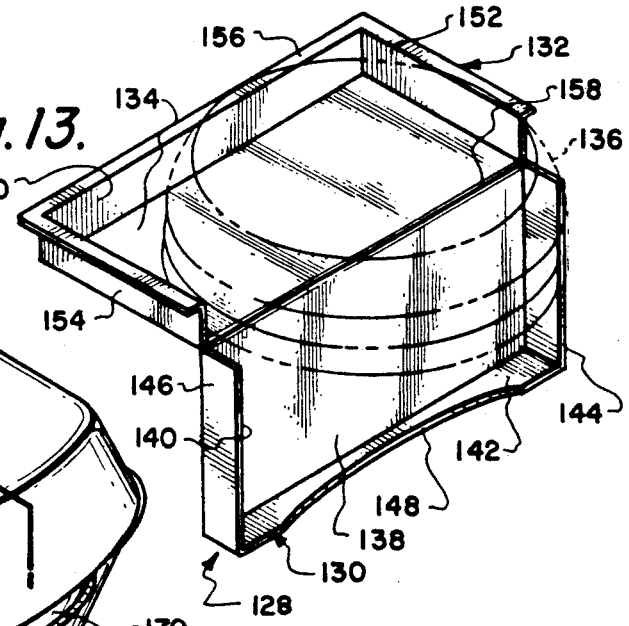
FIG. 13 is an isometric view of a modified form of tray shown in FIG. 3 which is utilized in conjunction with the sandwich serving container of the present invention.

Referring particularly to FIG. 13 of the drawings, there is shown a tray 128 which has a front section 130 and a back section 132. Placed on the planar bottom 134 of the back section 132 is the sandwich 136. It is to be understood that during the normal consuming procedure, a sandwich is held with the front end tilted up to the mouth while the consumer's head naturally bend downward, thus the planar bottom 134 will assume a tilted position from that shown in FIG. 13. This tilted position will orient the planar bottom 138 of the front section 130 at a forwardly inclined angle to facilitate collecting of any foodstuff drippings from the sandwich 136. It is to be understood that these foodstuff drippings are to collect within the chamber 140 which is formed by front wall 142 and side walls 144 and 146. The front wall 142 is to include a recess 148 so as it provide additional clearance for the consumer's chin (not shown).

The back section 132 has a back wall 150 and side walls 152 and 154. The upper edge of the side walls 152 and 154 as well as the back wall 150 include a flange 156. This flange 156 extends outwardly as opposed to the inward extension of the flange 46 shown in FIG. 3. The primary purpose of the flange 156 is to provide strength to the tray 128 while affording greater ease in stacking. It is also considered within the scope of this invention that the side walls 144, 146, 152, 154 as well as the front wall 142 and the back wall 150 could be outwardly tapered. This outward tapering would provide easier stacking of the trays 128 prior to their usage. It is to be understood that the front section 130 deflects relative to the back section 132 by means of bend line 158.

Figure 14:
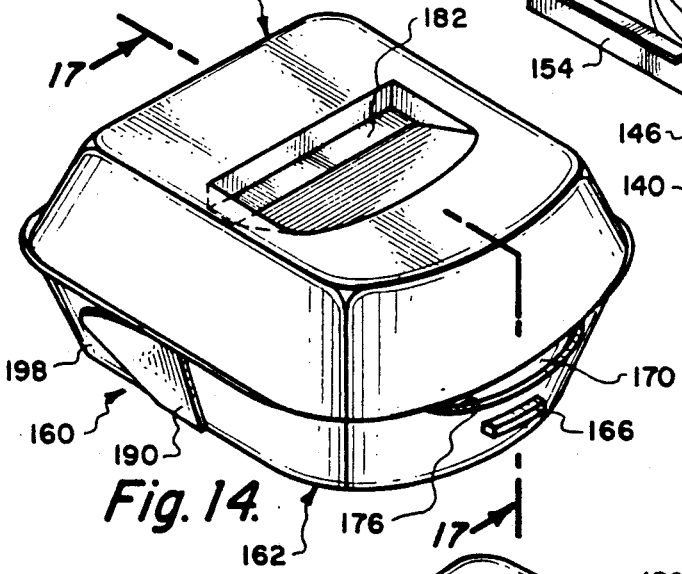
FIG. 14 is an isometric view of a further version of the sandwich container of the present invention showing the sandwich container in a closed position.
Figure 17:
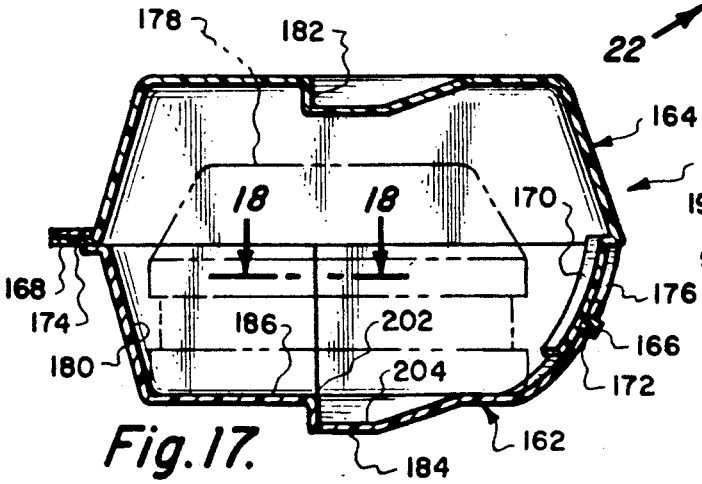
FIG. 17 is a cross-sectional view through the sandwich container of FIG. 14 taken along line 17—17 of FIG. 14.
Figure 18:
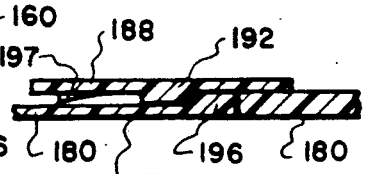
FIG. 18 is a cross-sectional view through a side wall latching arrangement utilized in conjunction with the sandwich container of FIG. 14 taken along line 18—18 of FIG. 17.

Referring particularly to FIGS. 14 and 17 there is shown a sandwich serving container 160. This sandwich serving container 160 is constructed of a tray 162 and a lid 164. This serving container 160 is the preferred embodiment for plastic/foam construction. The lid 164 is to be completely disengageable from the tray 162. The lid 164 includes a front latching protuberance 166 and a rear latching protuberance 168. The front latching protuberance 166 is mounted on a depending flange 170. The front latching protuberance 166 is to latchingly connect with an aperture 172 formed within the tray 162. The rear latching protuberance 168 is to engage with aperture 174 formed within the rear section of the tray 162. The aperture 172 is located beneath recess 176. The recess 176 is to provide additional clearance for the chin of the consumer during consuming of the sandwich 178 contained within the internal chamber 180 of the tray 162.

The lid 164 includes a stacking recess 182. This stacking recess 182 is to accommodate protrusion 184 formed within the bottom 186 of the tray 162. The protrusion 184 will just matingly locate within the recess 182 which will permit a container 160 to be placed on another such container 160 so that the containers 160 can can be stacked containing the hamburger within, ready to be served.

Figure 15:
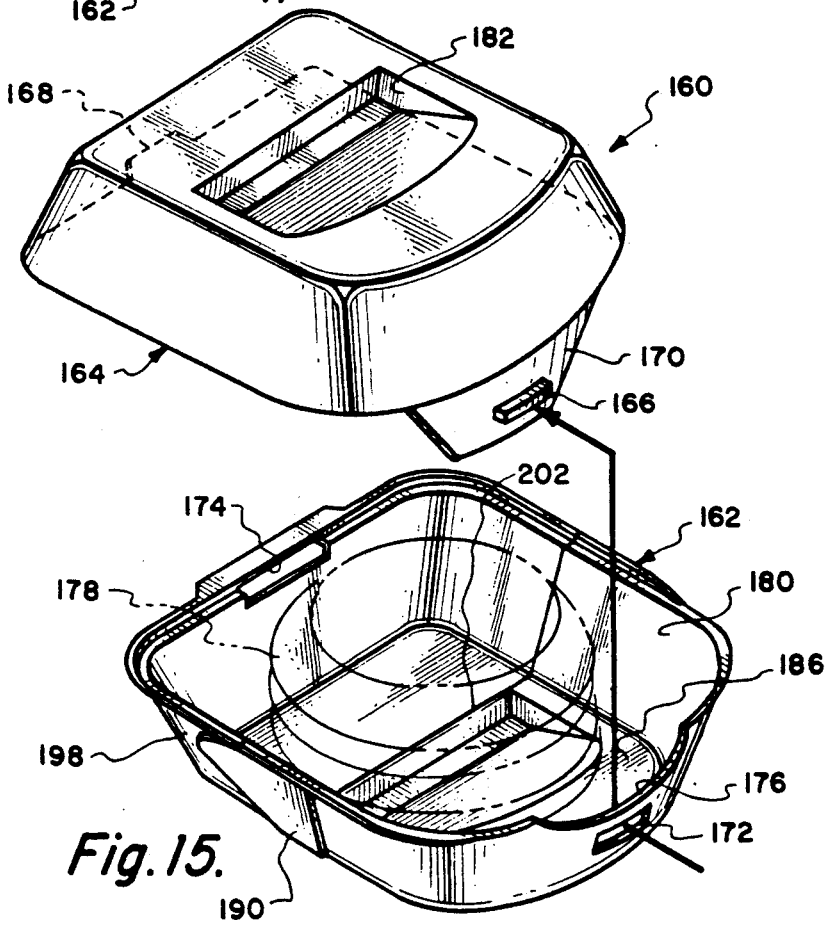
FIG. 15 is an isometric view of the sandwich container of FIG. 14 but with the lid separated from the tray exposing the sandwich contained within the sandwich container.
Figure 16:
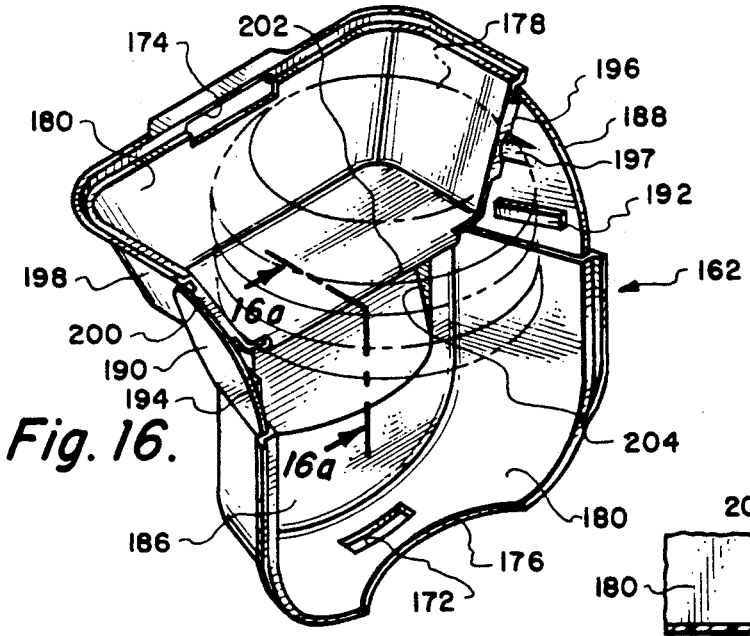
FIG. 16 is a view of the tray of the sandwich container of FIG. 14 showing the tray in the deflected position so as to facilitate consuming of the sandwich.
Figure 16A:
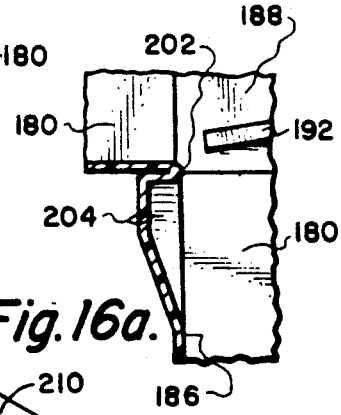
FIG. 16*a* is a cross sectional view taken along line 16*a*–16*a* of FIG. 16.

The tray 162 is formed into a back section and a front section with the aperture 174 being located in the back section and the aperture 172 being located in the front section. The front section includes a pair of facing side flanges 188 and 190 which are basically identical in construction. On the inner surface of the side flange 188 is located a protrusion 192. A similar protrusion 194 is mounted on the inside surface of the side flange 190. When the front section is in the closed position with the back section of the tray 162 as is shown in FIGS. 15 and 17, the protrusion 192 engages with and lays just rearwardly of a protrusion 196 formed on the exterior surface of the side wall 198 of the back section. At the same time the protrusion 194 engages with and lies just rearwardly of a protrusion 200 also formed on the exterior surface of the side wall 198. In essence, a locking or latching arrangement is obtained securing the base 162 in the closed position, to prevent the sandwich from dropping in case the majority of its weight shifts to the front section before the consumer opens the lid and is able to properly position his or her hand and sandwich on the back section.

At the time it is desired to consume the sandwich 178 the user is to outwardly deflect each of the side flanges 188 and 190 so as to permit the protrusions 192 and 194 to respectively pass over protrusions 196 and 200 thereby permitting pivoting of the front section of the base 162 relative to the back section on bend line 202. As the front section moves into the fully deflected position, protrusion 196 rides over a camming protuberance 197 mounted on the inside surface of side flange 188. Side flange 188 deflects slightly outwardly t permit camming protuberance 197 to pass by protrusion 196. Similarly, protrusion 200 will ride over a camming protuberance (not shown) mounted on the inside surface of side flange 190, and functions identical to camming protuberance 197. When camming protuberance 197 becomes free of protrusion 196, side flange 188 deflects back inwardly. The vertical back wall of camming protuberance 197 will now prevent movement of the front section back toward the back section thereby holding the base 162 in the deflected position. Normally, after the sandwich 178 has been consumed, the tray 162 is to be discarded. If for any reason the user wants to move the front section back to the closed position, the user must manually deflect each side flange 188 and 190 outwardly which will then permit such movement. In this open position a second benefit of the flanges 188 and 190 is to close the space created by the slit in the side walls, thus preventing spillage through that area.

The protrusion 184 provides a clearance chamber 204. The function of the clearance chamber 204 is provide adequate space for the consumer's lower lip and chin during the time the sandwich 178 is being consumed while being retained in conjunction with the tray 162. The front section of the tray 162 has part of the chamber 180 which functions to collect any drippings or crumbs that may be dislodged from the sandwich 178 during the consuming process.

Referring particularly to FIGS. 19 to 22 there is shown a further version 206 of the sandwich container of this invention. This is the preferred embodiment of the invention when construction is to be of paper material.

The sandwich 236 is to be located on the back section 238 of tray 240. This tray 240 includes a front section 242 which is capable of being moved to a deflected position as is readily apparent within FIG. 21 of the drawings. This deflection is similar to what has previously been described in relation to FIG. 13 and FIG. 3 and is for the same purpose. The front section 242 includes a recess 244 which is similar to recess 176 previously described.

The basic difference between tray 240 and the others is the including of an additional bend line 249 which positions the recess 244 towards the consumer with the rear portion of the front section 242 deflecting rearward (away from the consumer) due to the primary bend line 248. This positions the front section 242 away from the consumer's lower lip, allowing more clearance. This serves the same purpose as clearance chamber 204 in tray 162, FIGS. 14–17, which is formed of plastic. Since the preferred material for tray 240 is paper, the double bend line is necessary for the construction of this additional lower lip clearance area.

Another benefit of the double bend line is to provide a reduced amount of space in the "V" area of each side created by slit 251, dividing the side wall into parts 253 and 267 and slit 255 dividing side wall into parts 257 and 269 at the primary bend line 248, thus reducing spillage through these areas. There is also a slit 259 between flap 261 aligned with slit 251 and a slit 263 aligned with slit 255 which permits flap to bend relative to planar bottom 265 of front section 242.

The double bend line and the slits 251, 261, 255 and 263 produce a natural overlapping of the "V" area as front section 242 moves down and back at 248 and up at 249. This overlap is increased by making parts 267 and 269 of greater height than parts 253 and 257, and by the angle of slits 251 and 255, thus reducing the "V" area. Thus parts 267 and 269 serve a similar purpose of flanges 188 and 190 in FIG. 16. The reason for some of the above is because tray 240 is manufactured from a single die cut one piece folder with no structure added or cut off after the initial die cut. Thus, a low cost method for paper construction is achieved.

Figure 19:
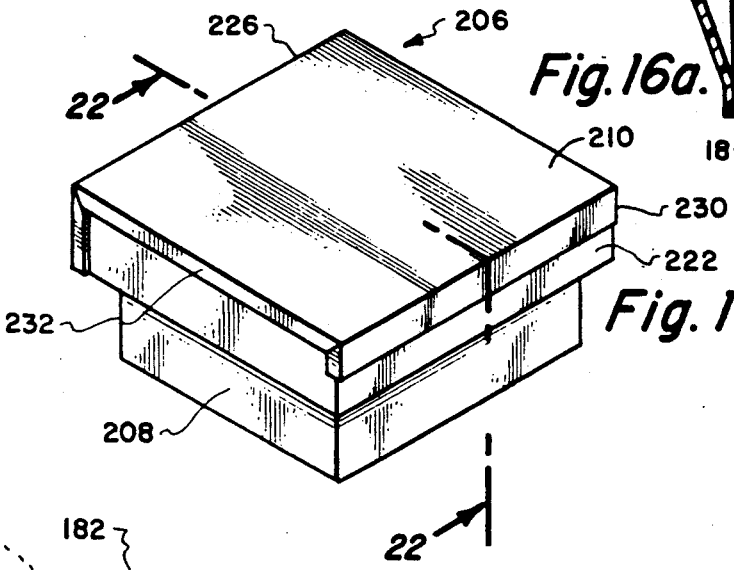
FIG. 19 is an isometric view of a further version of the sandwich container of the present invention showing the sandwich container in the closed position.

Because of the double bend line, more support is needed at the bottom of tray 240 prior to consumption. The cover for tray 240 may be any conventional four walled box with bottom and latching top. A further version of cover 206 is in the form of a base 208 and a lid 210 as a single unit with the lid 210 being hingeably moveable about a hinge line 212 from the closed position shown in FIG. 19 to the open position shown in FIG. 20. The base 208 includes a lower compartment 214 within which is to be located a foodstuff such as strips of potato 216. The base 208 includes an upper, larger compartment 218 with a ledge 220 dividing compartments 214 and 218. Compartment 218 is formed by means of side wall 222 which basically forms three sides of a square or rectangle with the back wall missing. This missing back wall is provided by means of wall 224 which connects between the hinge line 212 and the lid 210. Separating the back wall 224 and the lid 210 is a further hinge line 226. The outer edge of the lid 210 includes a front flap 228. The lid 210, when in the closed position, covers the chamber 218 with the front flap 218 overlaying a portion of the side wall 222. There may be incorporated some kind of a latching arrangement between the flap 228 and the side wall 222. The front flap 228 is capable of being pivoted relative to the lid 210 by means of hinge line 230 so that the front flap 228 can be placed abuttingly against the front section of the side wall 222 as is shown in FIG. 19. The lid 210 also includes depending side flanges 232 and 234. These side flanges 232 and 234 also abut against the side wall 222 when the lid 210 is in a closed position.

Figure 20:
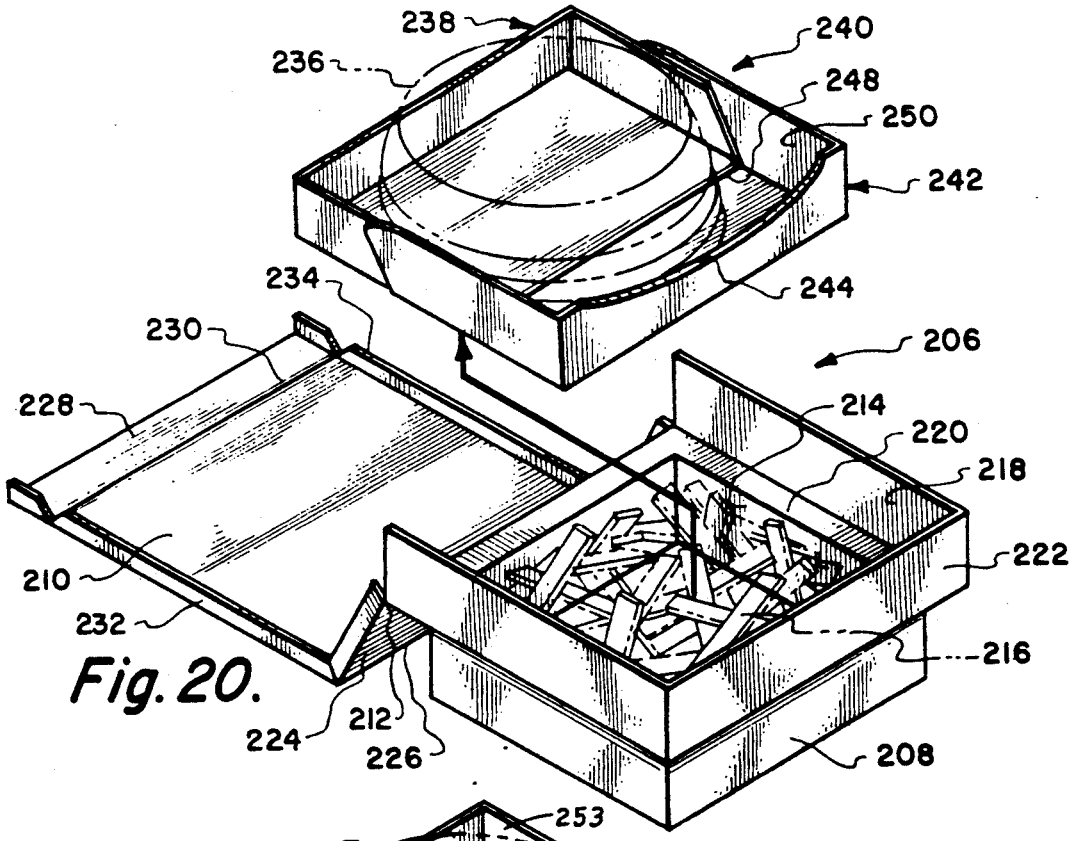
FIG. 20 is an exploded isometric view showing the sandwich container of FIG. 19 in the open position and with the tray which supports the sandwich being removed from the container.
Figure 21:
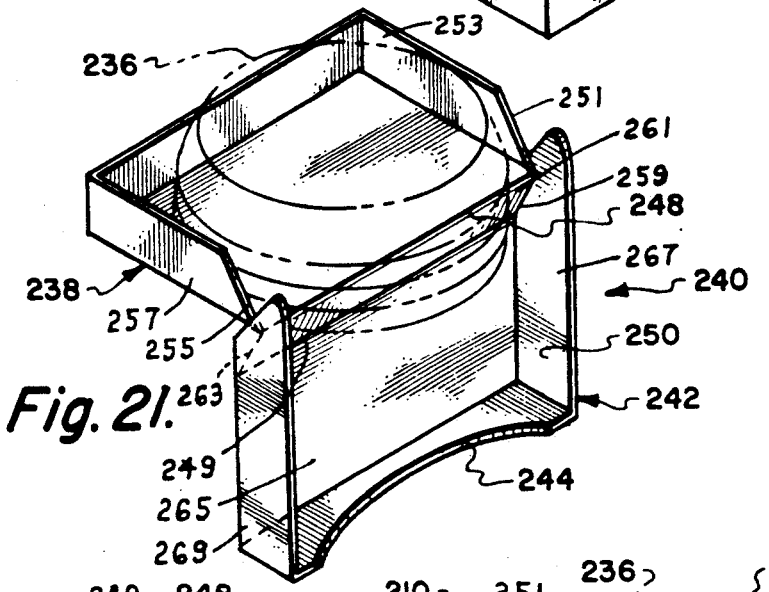
FIG. 21 shows the tray in the deflected position of the sandwich container of FIG. 19.
Figure 22:
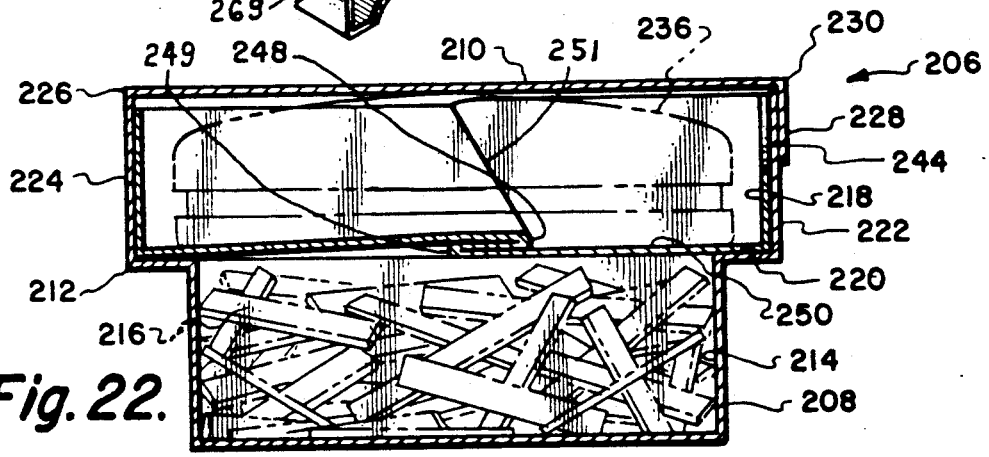
FIG. 22 is a cross-sectional view of the sandwich container as shown in FIG. 19 taken along line 22—22 of FIG. 19.

The advantage of the embodiment of this container shown in FIGS. 19, 20 and 22, is that the container 206 can be utilized to hold two different types of foodstuff. The sandwich 236 with the tray 240 is to be removed prior to consumption from the container 206. The tray 240 is to remain with the sandwich 236 during the consuming process with the collecting chamber 250 of the front section 242 functioning to collect any drippings or crumbs that may fall free of the sandwich 236, while the food in compartment 214 is now available to the consumer.

What is claimed is:

1. A sandwich serving container comprising:

a tray formed of a planar bottom having a peripheral edge, an upstanding wall attached to said planar bottom at said peripheral edge, said upstanding wall in combination with said bottom defining a chamber within which a sandwich is to be located, said tray including a bend line extending entirely across said planar bottom dividing said tray into a back section and a front section, said tray being locatable in either a closed position or a deflected position, with said tray i said closed position said planar bottom of said back section being aligned with said planar bottom of said front section, said front section assumes said deflected position by pivoting at said bend line relative to said back section causing said planar bottom of said front section to be angularly disposed relative to said planar bottom of said back section, whereby during consuming of a sandwich said back section is held in one hand of a human with said front section located at said deflected position which locates said front section to allow access to the sandwich by the mouth of the consumer with no interference to the lower lip, chin, neck or hands with said front section simultaneously functioning to catch and collect any food drippings that may occur during the consuming procedure; and an enclosing lid comprising a substantially rigid walled body to close said chamber to the ambient preventing consuming of the sandwich, said enclosing lid to be separated completely from said tray permitting consuming of the sandwich.

2. The sandwich serving container as defined in claim 1 wherein:

said upstanding wall having an upper edge with said upper edge being spaced furthest from said bottom, a flange attached to said upper edge, said flange being continuous when said tray is in said closed position and being only interrupted when said front section assumes said deflected position.

3. The sandwich serving container as defined in claim 2 wherein:

said flange extending into said chamber decreasing the entry size of said chamber.

4. The sandwich serving container as defined in claim 1 wherein:

said enclosing lid having a front flap and a back end spaced furthest from said front flap, said enclosing lid having an open bottom except for a bottom flange at said back end, said enclosing lid to connect with and be retainingly held by said bottom flange at said back end, a latch located at said front flap to secure together said enclosing lid on said tray, said latch comprising an aperture within said enclosing lid which connects with a protuberance on said tray.

5. The sandwich serving container as defined in claim 4 wherein:

said latch being spaced from said bend line.

6. The sandwich serving container as defined in claim 4 wherein:

said latch aligning with said bend line.

7. The sandwich serving container as defined in claim 1 wherein:

an enclosing cover comprising a flexible walled bag which totally encloses said tray.

8. The sandwich serving container a defined in claim 1 wherein:

a rigid support plate located within said tray, said rigid support plate resting on and substantially covering the entire area of said planar bottom, said rigid support plate being removeable prior to consuming of the sandwich.

9. The sandwich serving container as defined in claim 1 wherein:

said upstanding wall including side flanges, each said side flange overlapping a portion of said upstanding wall, each said side flange including a pair of spaced apart protrusions with one said protrusion to define said closed position and the other protrusion to define said deflected position.

10. A sandwich serving container comprising:

a tray formed of a planar bottom having a peripheral edge, an upstanding wall attached to said planar bottom at said peripheral edge, said upstanding wall i combination with said bottom defining a chamber within which a sandwich is to be located, said tray including a bend line extending entirely across said planar bottom dividing said tray into a back section and a front section, said tray being locatable in either a closed position or a deflected position, with said tray in said closed position said planar bottom of said back section being aligned with said planar bottom of said front section, said front section assumes said deflected position by pivoting at said bend line relative to said back section causing said planar bottom of said front section to be angularly disposed relative to said planar bottom of said back section, whereby during consuming of a sandwich said back section is held in one hand of a human consumer with said front section located at said deflected position which locates said front section to allow access to the sandwich by the mouth of the consumer with no interference to the lower lip, chin, neck or hands with said front section simultaneously functioning to catch and collect any food drippings that may occur during the consuming procedure; and there being a pair of said bend lines formed in said planar bottom in a spaced apart arrangement which causes said front section to not only deflect but move toward and partially underneath said back section.

11. A tray formed of a planar bottom having a peripheral edge, an upstanding wall attached to said planar bottom at said peripheral edge, said upstanding wall in combination with said bottom defining a chamber within which a sandwich is to be located, said tray including a bend line extending entirely across said planar bottom dividing said planar bottom into a back section and a front section, said front section being capable of assuming a deflected position by being deflectable at said bend line relative to said back section causing said planar bottom of said front section to be angularly disposed relative to said planar bottom of said back section, whereby during consuming of a sandwich said back section is held in the hand of a human with said front section being located at said deflected position which positions said front section to not interfere with the consuming of the sandwich plus said front section functions to catch and collect any food drippings that may occur during the consuming procedure; and an enclosing lid comprising a substantially rigid walled body to close said chamber to the ambient preventing consuming of the sandwich, said enclosing lid to be separated completely from said tray permitting consuming of the sandwich.

12. The sandwich serving container as defined in claim 11 wherein:

said upstanding wall having an upper edge with said upper edge being spaced furthest from said planar bottom, a flange attached to said upper edge, said flange being continuous and being only interrupted when said front section assumes said deflected position.

13. The sandwich serving container as defined in claim 12 wherein:

said flange being located parallel to said bottom.

14. The sandwich serving container as defined in claim 11 wherein:

an enclosing lid connectable to said tray functioning to close said chamber to the ambient, said enclosing lid comprising a substantially rigid walled body, said body to be slipped over and retainingly held by retaining means on said tray, said retaining means including a protuberance mounted on said upstanding wall, said protuberance functioning as a latch to engage with an aperture formed within said enclosing lid.

15. The sandwich serving container as defined in claim 14 wherein:

said latch being spaced from said bend line.

16. The sandwich serving container as defined in claim 14 wherein:

said latch being in alignment with said bend line.

17. The sandwich serving container as defined in claim 11 wherein:

a rigid support plate being removeably placed on said tray within said chamber, said rigid support plate substantially covering the entire area of said planar bottom.

18. The sandwich serving container as defined in claim 11 wherein:

said planar bottom including an enlarged protrusion providing additional lower lip and chin clearance to the consumer during consumption of the sandwich.

19. The sandwich serving container as defined in claim 18 wherein:

an enclosing lid connectable to said tray functioning to close said chamber to the ambient, said enclosing lid being of rigid walled construction, said enclosing lid including a stacking recess, said enlarged protrusion of a said container to engage with a said stacking recess of another said container when said container is located in a stacked relationship.

20. A sandwich serving container comprising:

a tray formed of a planar bottom having a peripheral edge, an upstanding wall attached to said planar bottom at said peripheral edge, said upstanding wall in combination with said bottom defining a chamber within which a sandwich is to be located, said tray including a bend line extending entirely across said planar bottom dividing said tray into a back section and a front section, said front section being capable of assuming a deflected position by being deflectable at said bend line relative to said back section causing said planar bottom of said front section to be angularly disposed relative to said planar bottom of said back section, whereby during consuming of a sandwich said back section is held in open hand of a human with said front section located at said deflected position which positions said front section to not interfere with the consuming of the sandwich plus said front section functions to catch and collect any food drippings that may occur during the consuming procedure; and said tray being located within a separate container of said sandwich serving container, said tray to be disengaged to be removable from said separate container, said separate container including a separate foodstuff containing compartment.

21. A sandwich serving container comprising:

a tray formed of a planar bottom having a peripheral edge, an upstanding wall attached to said planar bottom at said peripheral edge, said upstanding wall in combination with said bottom defining a chamber within which a sandwich is to be located, said tray including a bend line extending entirely across said planar bottom dividing said planar bottom into a back section and a front section, said front section being capable of assuming a deflected position by being deflectable at said bend line relative to said back section causing said planar bottom of said front section to be angularly disposed relative to said planar bottom of said back section, whereby during consuming of a sandwich said back section is held in the hand of a human with said front section being located at said deflected position which positions said front section to not interfere with the consuming of the sandwich plus said front section functions to catch and collect any food drippings that may occur during the consuming procedure; and there being a pair of said bend lines formed in said planar bottom in a spaced apart arrangement which causes said front section to not only deflect but move toward and partially underneath said back section.

* * * * *